US005431465A

United States Patent [19]

Shibata

[11] Patent Number: 5,431,465

[45] Date of Patent: Jul. 11, 1995

[54] CHOPSTICKS

[75] Inventor: Iseo Shibata, Fukuoka, Japan

[73] Assignee: Acta Corporation, Fukuoka, Japan

[21] Appl. No.: 271,346

[22] Filed: Jul. 6, 1994

[51] Int. Cl.[6] ..... A47G 21/00

[52] U.S. Cl. ..... 294/1.1; 294/5.5

[58] Field of Search ..... 294/1.1, 5, 5.5, 19.1, 294/23.5, 26, 99.2; 16/115; 30/123, 142, 143, 151, 162, 164.5, 164.7, 322–324, 326, 340; 239/33; 403/109, 298, 359, 375, 377; 426/134; D7/642, 643, 664

[56] References Cited

FOREIGN PATENT DOCUMENTS 4215712 8/1992 Japan ..... 294/1.1

*Primary Examiner*—Johnny D. Cherry
*Attorney, Agent, or Firm*—Jordan and Hamburg

[57] ABSTRACT

Each of a pair of chopsticks has a case made of a synthetic resin, having an open front end, and a food holding member made of wood or bamboo, housed in the case slidably between its retracted and extended positions through the front end of the case. The holding member is greater in length than the case. The case has at least two diametrically opposed projections formed on its inner surface adjacent to its front end, and has therebetween a distance which is smaller than the diameter of the holding member in its inner end portion. The case also has at least one protruding wall portion formed on its inner surface inwardly of the projections, giving the case an inside diameter which is slightly smaller than the diameter of the holding member in its inner end portion. The holding member has an annular groove formed in its peripheral surface at its inner end portion, and the projections engage the groove when the holding member is in the extended position.

4 Claims, 3 Drawing Sheets

CHOPSTICKS

BACKGROUND OF THE INVENTION

1. Field of the Invention

This invention relates to chopsticks which are convenient for attaching to an ordinary lunch box, a vessel containing precooked noodles, etc., and are handy to carry, and which can be used repeatedly.

2. Prior Art

Chopsticks of telescopic construction which are used for lifting food have been known. Each chopstick comprises a holding member made of a natural fibrous material, such as wood or bamboo, and a case formed from a synthetic resin for housing the holding member. The holding member is slidable out of, and retractable back into, the case. The outer surface of the holding member adjacent to its inner end and the inner surface of the case adjacent to its open end have a plurality of annular ridges and grooves which are engageable with each other to fix the holding member to the case when the former is in the extended position.

The known chopsticks can be retracted for carrying or storage, and they can be extended to ordinary chopstick length when they are used. As the holding members which are used for holding food therebetween are made of a natural fibrous material, e.g. wood or bamboo, the user of the chopsticks does not feel anything unusual when he tries to lift food. The chopsticks are suitable for repeated use. They are suitable for lifting noodles, as they do not readily allow any slipping that is very likely to occur with plastic chopsticks. The telescopic chopsticks also contribute to reducing the consumption of wood, insofar as the holding members are shorter than ordinary chopsticks.

The known chopsticks are, however, less easy to use than ordinary chopsticks of simple or unitary construction. As the holding member of each chopstick is not firmly secured to the case, slight movement relative to the case is unavoidable. The known chopsticks, therefore, lack rigidity and stability in use.

SUMMARY OF THE INVENTION

It is, therefore, an object of this invention to provide improved telescopic chopsticks which are rigid and stable in use, and as easy to use as ordinary chopsticks.

This object is attained by a pair of chopsticks each comprising a case made of a synthetic resin, and having an open front end, and a holding member made of a natural fibrous material, such as wood or bamboo, which is housed in the case so as to slide between its retracted and extended positions, the holding member having a greater length than the case, the case having at least two opposing projections formed on its inner surface adjacent to its front end and having therebetween a distance which is smaller than the diameter of the holding member at its inner end, the case also having at least one protruding wall portion formed on its inner surface inwardly of the projections and giving the case an inside diameter which is slightly smaller than the diameter of the holding member near its inner end, while the holding member has a groove formed in its peripheral surface near its inner end to engage with the projections of the case when the holding member is extended.

The compressibility of the natural fibrous material forming the holding member and the flexibility and workability of the synthetic resin forming the case ensure that, when the holding member is extended to enable use of the chopstick, it can be firmly secured in the extended position without making any undesirable movement relative to the case, so that the chopsticks of this invention may be as easy to use as any ordinary chopsticks.

The case may be circular, square, or otherwise polygonal in cross section along both of its inner and outer peripheral surfaces, or may have a different cross section along its inner peripheral surface from along its outer peripheral surface. The holding member, with which food is held and lifted, may likewise have any of various shapes in its cross section, though its diameter or thickness should be relatively large toward its inner end and relatively small toward its outer end where the chopstick is brought into contact with food.

The case may have at its rear end an opening which is closed with a cover after admitting the holding member therethough, so that the chopstick may have an optimum shape for its use. The case may further have an axially projecting portion outwardly of the projections for engaging the periphery of the holding member and supporting it when it is extended.

The chopsticks of this invention have, therefore, a number of advantages as summarized below:

(1) The chopsticks are convenient to carry in the retracted state, and can be extended to be used like ordinary chopsticks by simply drawing the holding members out of the cases;

(2) The projections and protruding wall portion on the inner surface of each chopstick provide a rigid and stable support for the holding member to prevent any undesirable movement relative to the case when it is in its extended position, even if the chopsticks are repeatedly used. This support is further reinforced by the axially projecting portion of the case; and (3) The chopsticks can be made to any desired length in their shortened form that makes them suitable for attachment to a lunch box, vessel containing precooked noodles, etc.

These and other features and advantages of this invention will become apparent from the following description and the accompanying drawings.

DETAILED DESCRIPTION OF THE INVENTION

Figure 1:
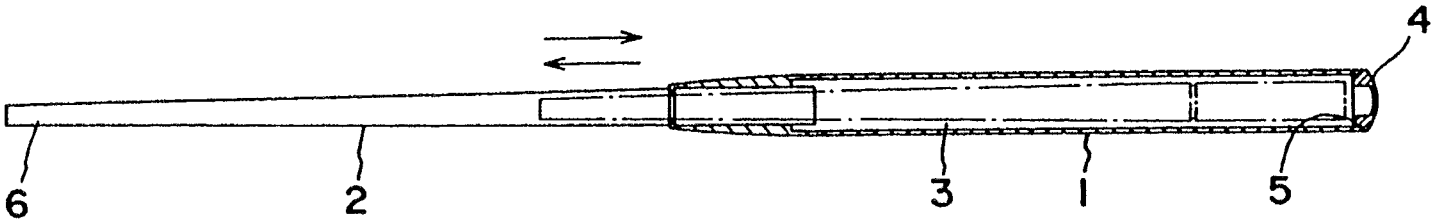
FIG. 1 is a side elevational view of a chopstick embodying this invention showing it in two positions.

One of a pair of chopsticks embodying this invention is shown in FIG. 1, and comprises a case 1 and a holding member 2. The holding member 2 is shown in two positions, i.e. the retracted position, in which it is withdrawn into the case 1, is shown by broken lines, and the extended position, in which it is drawn out of the case, is shown by solid lines.

The case 1 is formed from a synthetic resin and has an axial bore 3. The case 1 has at its rear end an opening 5 closed with a cover 4 after the insertion of the holding member 2 therethrough into the case 1. The case 1 is somewhat smaller in length than the holding member 2, so that the holding member 2 may have its front end portion 6 projecting from the front end of the case 1 even when it is in the retracted position as shown by the broken lines, and may, therefore, be easily drawn out from the case 1.

The case 1 and the holding member 2 may have any of various shapes in cross section, though they are both shown as being circular. The case 1 should have an octagonal or hexagonal cross section along its outer periphery to provide a slip-proof surface. The holding member 2 will preferably have a circular cross section for chopsticks used for rice, or an octagonal cross section for chopsticks for noodles, so that noodles will not slip off the chopsticks.

When the chopstick is used, the projecting end of the holding member 2 is extended from the case 1. The holding member 2 is firmly secured to the case 1 as if the pair were a single chopstick.

Figure 2:
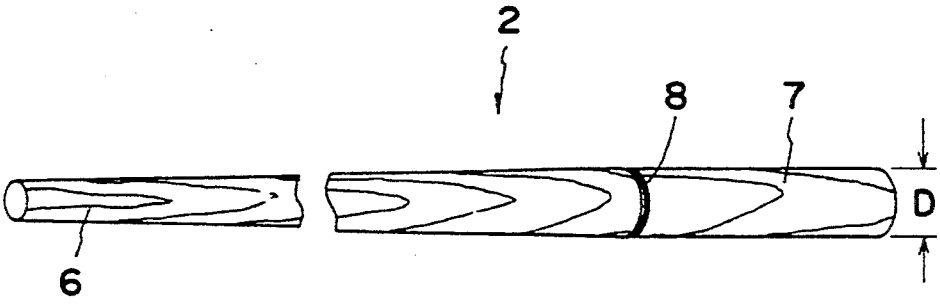
FIG. 2 is an enlarged and partly omitted perspective view of a holding member.
Figure 3:
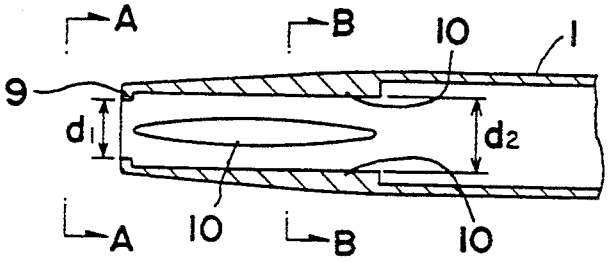
FIG. 3 is an enlarged longitudinal sectional view of the front end portion of a case.
Figure 4:
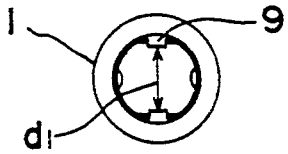
FIG. 4 is an end view taken along the line A—A of FIG. 3.

Reference is now made to FIGS. 2 to 6 showing how the holding member 2 is secured to the case 1. The holding member 2 has an annular groove 8 formed about its inner end portion 7, as shown in FIG. 2. The case 1 has at its front end an opening through which holding member 2 projects outwardly, as shown in FIG. 1. The case 1 has two diametrically opposite projections 9 formed on its inner surface adjacent to its front end, as shown in FIG. 3 or 4. The number of the projections 9 is, however, not limited to two, but may instead be, for example, two pairs, if each pair of projections are diametrically opposite each other.

Figure 6:
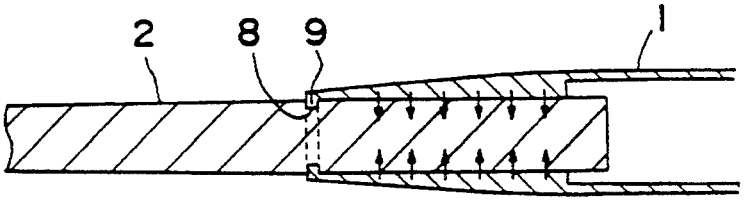
FIG. 6 is a fragmentary enlarged view of the chopstick in one of the two positions shown in FIG. 1 which shows how the holding member is secured by the case.

If the holding member 2 is drawn out as shown in FIG. 1, the projections 9 will engage the annular groove 8 of the holding member 2 as shown in FIG. 6, whereby the holding member 2 will be secured in its outer position. The projections 9 have therebetween a distance $d_1$ which is smaller than the diameter D of the holding member 2 in its inner end portion 7, while the groove 8 is sufficiently deep to allow the projections 9 to fit snugly within. In this connection, a still better result can be obtained if the case 1 has a plurality of pairs or sets of projections 9 engaging a plurality of annular grooves 8, respectively, on the holding member 2. After the chopstick has been used, the holding member 2 is retracted into the case 1. The case 1 is made of a fairly flexible synthetic resin, and the holding member 2 is of wood, or a like material that provides a workable surface. So, the firm engagement of the holding member 2 with the case 1 is not readily lost, even if use and retraction of the holding member 2 is often repeated.

Figure 5:
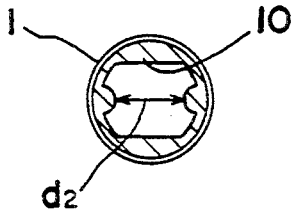
FIG. 5 is a sectional view taken along the line B—B of FIG. 3.

The case 1 also has two pairs of diametrically opposed protruding wall portions 10 formed on its inner surface inwardly or rearwardly of the projections 9, as shown in FIGS. 3 and 5. One of the two pairs of protruding wall portions 10 are smaller in cross section than the other pair, so that they may not exert a great deal of resistance against the holding member 2 when it is drawn out. The four portions 10 are equally spaced apart from one another along the circumference of the case 1, as is obvious from FIG. 5. Each pair of protruding wall portions 10 have therebetween a distance $d_2$ which is equal to, or slightly smaller than, the diameter D of the holding member 2 in its inner end portion 7, so that they may fit tightly on the periphery of the holding member 2 in its inner end portion 7 to hold it against any undesirable movement relative to the case 1 when it is extended. Although the case 1 has been described as having a plurality of protruding wall portions 10, it is alternatively possible to form a single protruding wall portion surrounding the entire periphery of the holding member 2.

When the holding member 2 has been drawn out from the case 1, the projections 9 of the case 1 engage the annular groove 8 of the holding member 2, and the protruding wall portions 10 of the case 1 hold the holding member 2 on four sides thereof along the whole length of its inner end portion 7 to prevent its movement. It will, therefore, be obvious that the chopsticks of this invention can be used as easily and efficiently as any ordinary chopsticks.

The chopstick may further include a cap, not shown, to cover the projecting end portion 6 of the holding member 2 in its retracted position, to keep it clean for any repeated use.

Figure 7:
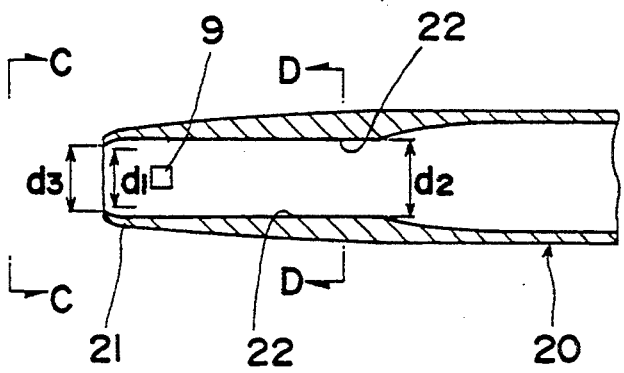
FIG. 7 is a fragmentary longitudinal sectional view of a case in another chopstick embodying this invention.
Figure 8:
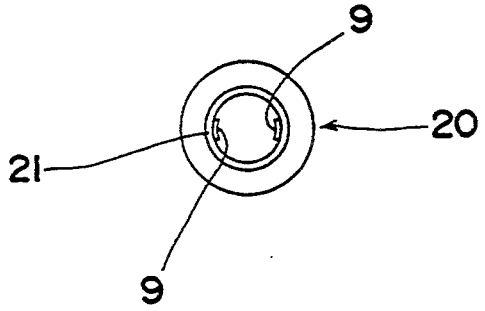
FIG. 8 is an end view taken along the line C—C of FIG. 7.
Figure 9:
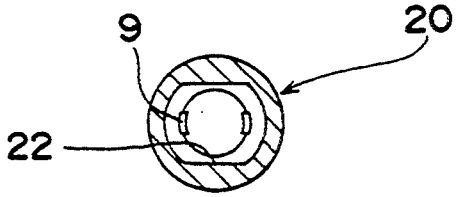
FIG. 9 is a sectional view taken along the line D—D of FIG. 7.

Attention is now directed to FIGS. 7 to 10 showing another chopstick embodying this invention. It includes a case 20 having a pair of diametrically opposed projections 9 formed on its inner surface inwardly of its open front end and a pair of diametrically opposed protruding wall portions 22 formed on its inner surface inwardly or rearwardly of the projections 9, as shown in FIGS. 7 and 9. The protruding wall portions 22 have therebetween a distance $d_2$ which is equal to, or slightly smaller than, the diameter D of the holding member 2 in its inner end portion 7.

Figure 10:
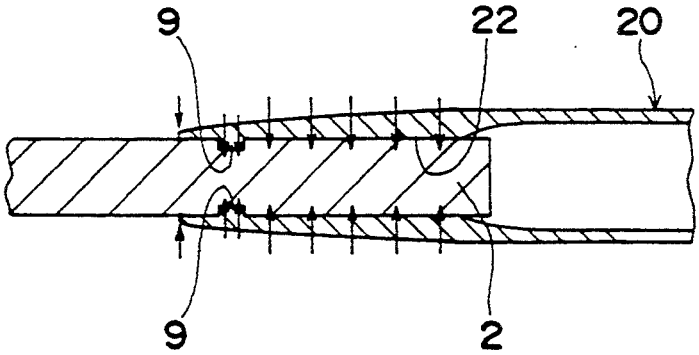
FIG. 10 is a fragmentary side elevational view, partly in section, showing a holding member secured by the case shown in FIG. 7.

The case 20 also has an axially projecting portion 21 formed outwardly of the projections 9 and terminating in the open front end of the case 20. The axially projecting portion 21 engages the periphery of the holding member 2 in its inner end portion 7 to support it when it has been drawn out from the case 20. The axially projecting portion 21 is slightly radially inwardly curved at the front end of the case 20 and has an inside diameter $d_3$ which is slightly smaller than the diameter D of the holding member 2 in its inner end portion 7 at the front end of the case 20. When the holding member 2 has been drawn out, the axially projecting portion 21 undergoes elastic radial deformation to provide a reinforced support for the holding member 2. Its entire inner surface engages the holding member 2, which is already held in position by the projections 9 engaging the annular groove 8 of the holding member 2, and the protruding wall portions 22, as shown in FIG. 10. The axially projecting portion 21 also helps to prevent any dust from entering the case 20 and thereby keeps its inside clean, since it closely fits the holding member 2 around the front end of the case 20.

Other features of the chopstick are equal to those of the chopstick which has hereinbefore been described with reference to FIGS. 1 to 6. Reference is, therefore, made to the foregoing description for any other features, whether they may appear in FIGS. 7 to 10 or not.

What is claimed is:

1. A pair of chopsticks, each comprising a case made of a synthetic resin, and having an open front end, and a holding member made of a natural fibrous material, and housed in said case slidably between its retracted and extended positions through said end, said holding member being greater in length than said case, said case having at least two opposing projections formed on its inner surface adjacent to said end and having therebetween a distance which is smaller than the diameter of said holding member in its inner end portion, said case also having at least one protruding wall portion formed on said inner surface inwardly of said projections and giving said case an inside diameter which is slightly smaller than said diameter of said holding member, while said holding member has a groove formed in its peripheral surface in said inner end portion engageable with said projections when said holding member is in said extended position.

2. A pair of chopsticks as set forth in claim 1, wherein said case also has an axially projecting portion formed outwardly of said projections and terminating in said open front end to engage said peripheral surface of said holding member and thereby support it when said holding member is in said extended position.

3. A pair of chopsticks as set forth in claim 1 or 2, wherein said natural fibrous material is selected from the group consisting of wood and bamboo.

4. A pair of chopsticks as set forth in claim 2, wherein said axially projecting portion is slightly curved radially inwardly and axially outwardly of said case at said front end.

* * * * *